US007867028B2

(12) United States Patent
Brown

(10) Patent No.: US 7,867,028 B2
(45) Date of Patent: Jan. 11, 2011

(54) REMOTE DETECTION OF PARTIALLY SEATED ELECTRICAL TERMINAL

(75) Inventor: Michael Dale Brown, Colfax, NC (US)

(73) Assignee: Tyco Electronics Corporation, Berwyn, PA (US)

( * ) Notice: Subject to any disclaimer, the term of this patent is extended or adjusted under 35 U.S.C. 154(b) by 228 days.

(21) Appl. No.: 12/151,556

(22) Filed: May 7, 2008

(65) Prior Publication Data

US 2009/0280696 A1 Nov. 12, 2009

(51) Int. Cl.
*H01R 13/44* (2006.01)

(52) U.S. Cl. ..... 439/595

(58) Field of Classification Search ..... 439/595
See application file for complete search history.

(56) References Cited

U.S. PATENT DOCUMENTS 4,969,841 A * 11/1990 Sueyoshi et al. ..... 439/595
7,004,790 B2 2/2006 Martin
7,044,808 B1 5/2006 Foltz
7,063,578 B2 6/2006 Goto
7,261,575 B2 8/2007 Buchter
7,467,958 B2 12/2008 Patterson

* cited by examiner

*Primary Examiner*—Ross N Gushi

(57) ABSTRACT

An electrical connector assembly is described which comprises an insulative housing comprised of at least one terminal receiving cavity, having a terminal opening and a mating terminal opening. A primary latch is positioned in the cavity provides a space between the primary latch and a base wall and an insulative contact extends laterally of the primary latch and is profiled to deflect the primary latch towards the base wall upon deflection of the insulative contact. An electrical terminal is positioned in the at least one cavity; and a terminal position assurance member is insertable below the primary latch and within the space. When the electrical terminal is fully positioned, the space is sufficient to accept the terminal position assurance member, and when the terminal is not fully inserted, the insulative contact is deflected by the electrical terminal, and the space is insufficient to accept the electrical terminal.

18 Claims, 13 Drawing Sheets

REMOTE DETECTION OF PARTIALLY SEATED ELECTRICAL TERMINAL

FIELD OF INVENTION

This application relates to electrical connector assemblies and more particularly to an electrical connector assembly having a terminal position assurance member which detects whether an electrical terminal is fully seated within a corresponding housing.

BACKGROUND OF INVENTION

In many applications it is required to detect whether electrical terminals are fully seated within their corresponding housing. For example in the case of a multi-positioned electrical connector, multiple individual terminals are terminated to electrical wires, and each individual terminal and the wire are loaded into an insulating housing. In the event that one or more of the terminals is not fully seated, it is possible that this condition is unnoticed and upon mating with its corresponding connector part, it is possible that the unseated terminals actually get pushed out of its corresponding housing upon the attempted mating of the two connectors; or that no contact at all is made between the unseated terminal and the terminal in the corresponding connector part.

It has therefore become known in the connector industry to provide a so-called terminal positioned assurance member (TPA), which is typically a separate device, for example, a separate housing part which is insertable into the connector housing, and which may be fully inserted upon the full insertion of all of the electrical terminals, but not insertable if one or more terminals is not fully seated. In such an event, it is visibly noticeable from the exterior of the connector that the TPA is not fully seated, providing an indication that one or more terminals are not fully seated. And in some applications, if the TPA itself is not fully seated, it is impossible to mate the electrical connector with its corresponding counterpart connector.

One example of a connector design provides a primary latch which, when the terminal is fully seated, is latched behind an electrical terminal which is insertable in the electrical connector housing, where the TPA is insertable from a front of the connector having one or more tines which are positioned below the primary latch. In the event that the terminal is not fully seated, the primary latch is deflected providing inadequate space beneath the primary latch for the insertion of the TPA.

In some applications, the terminal geometry prevents the primary latch from being used as a portion of the TPA assembly. For example, it is customary that in order for the primary latch to be used with the terminal positioned assurance member, that the primary latch requires some modification to include an enlarged contact surface, such that the primary latch is adequately deflected upon partial insertion of a terminal. Some terminals, due to the location of the locking lance, cannot have both the modified latch, as well as the modified latch properly seat upon full insertion of the terminal.

These and other objects are accomplished by the disclosed embodiments.

SUMMARY OF INVENTION

An electrical connector assembly comprises an insulative housing including at least one terminal receiving cavity, having a terminal opening and a mating terminal opening. A primary latch is positioned in the cavity and provides a space between the primary latch and a base wall and an insulative contact extends laterally of the primary latch and is profiled to deflect the primary latch towards the base wall upon deflection of the insulative contact. An electrical terminal is positioned in the at least one cavity; and a terminal position assurance member is insertable below the primary latch and within the space. When the electrical terminal is fully positioned, the space is sufficient to accept the terminal position assurance member, and when the terminal is not fully inserted, the insulative contact is deflected by the electrical terminal, and the space is insufficient to accept the electrical terminal.

In another embodiment, an electrical connector assembly comprises an insulative housing having at least one terminal receiving cavity, having a terminal opening and a mating terminal opening. A primary latch is positioned in the cavity providing a space between the primary latch and a base wall, and an insulative contact is positioned within the cavity. An electrical terminal is positioned in the at least one cavity and a terminal position assurance member is insertable below the primary latch and within the space. The insulative contact is profiled to deflect upon insertion of the electrical terminal and transfer the deflection to the primary latch. When the electrical terminal is fully positioned, the space is sufficient to accept the terminal position assurance member, and when the electrical terminal is not fully inserted, the insulative contact is deflected by the electrical terminal, and the space is insufficient to accept the electrical terminal.

In yet another embodiment, an electrical connector assembly is comprised of an insulative housing including at least one terminal receiving cavity, having a terminal opening and a mating terminal opening. An electrical terminal is positioned in the at least one cavity, where the electrical terminal has a locking surface positioned a first distance from an inside surface of the receiving cavity upon full insertion of the terminal. A primary latch is positioned in the cavity with a latching surface proximate the first distance to lock the terminal. An insulative contact is positioned within the cavity, whereby; when the electrical terminal is fully positioned, the primary latch locks the terminal in place, and when the terminal is not fully inserted, the electrical terminal engages the insulative contact, and transfers the deflection to the primary latch.

DETAILED DESCRIPTION OF THE EMBODIMENTS

Figure 1:
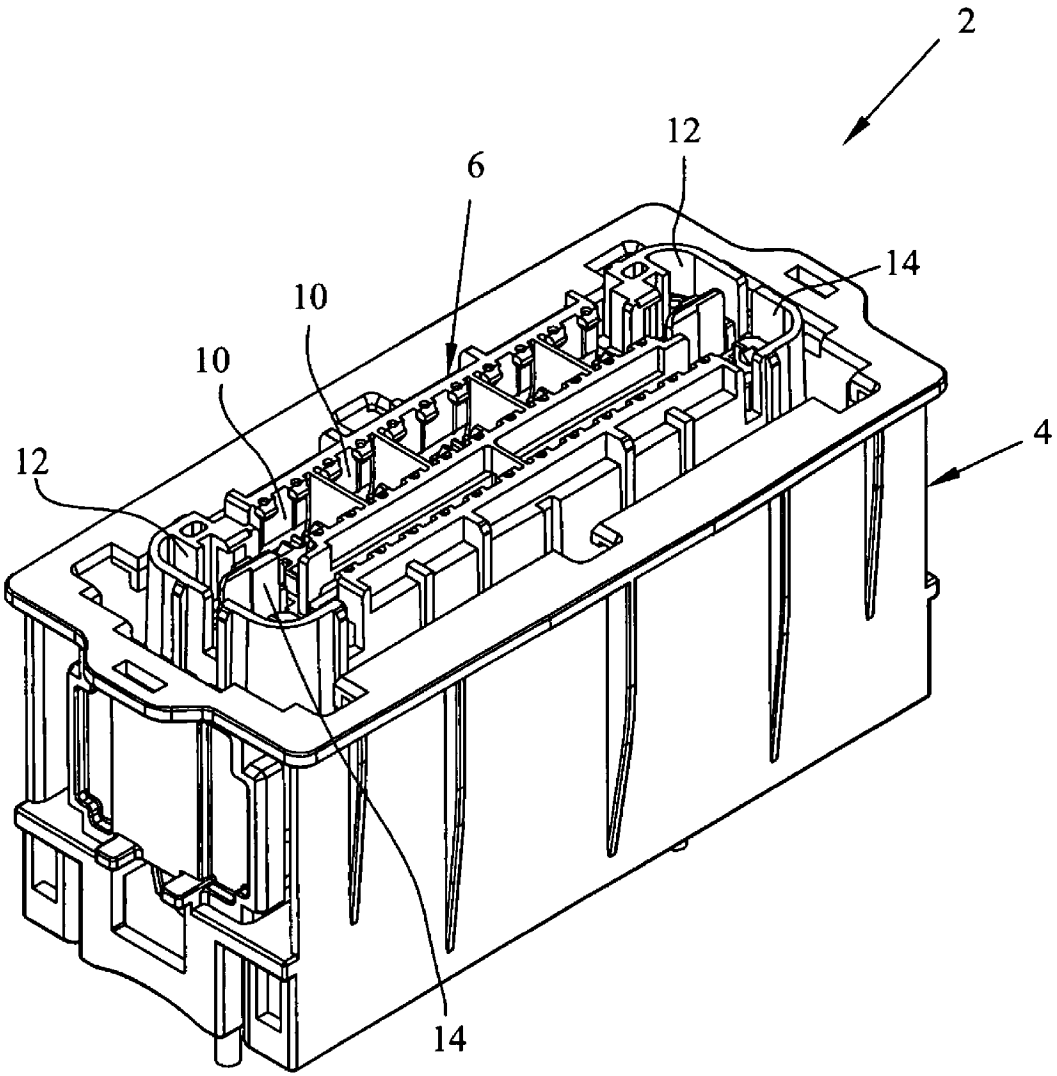
FIG. 1 is a perspective view of the assembled electrical connector assembly.

With reference first to FIG. 1, an electrical connector assembly is shown at 2, where the assembly is comprised of insulating housing 4 and terminal position assurance member (TPA) 6. As shown in FIG. 1, multiple terminal receiving cavities are provided by the combination of insulative housing 4 and TPA 6. For example, a plurality of terminal receiving cavities for small terminals are provided for example at 10, cavities provide for intermediate terminals are provided at 12 and cavities for large terminals are provided at 14. It is the latter terminal receiving cavities, namely cavities 14, which are the subject of the present application, however the principles associated with the present invention can be used in any electrical connector housing regardless of the size of the terminal, nor do multiple sizes of terminals need be present.

Figures 2, 3:
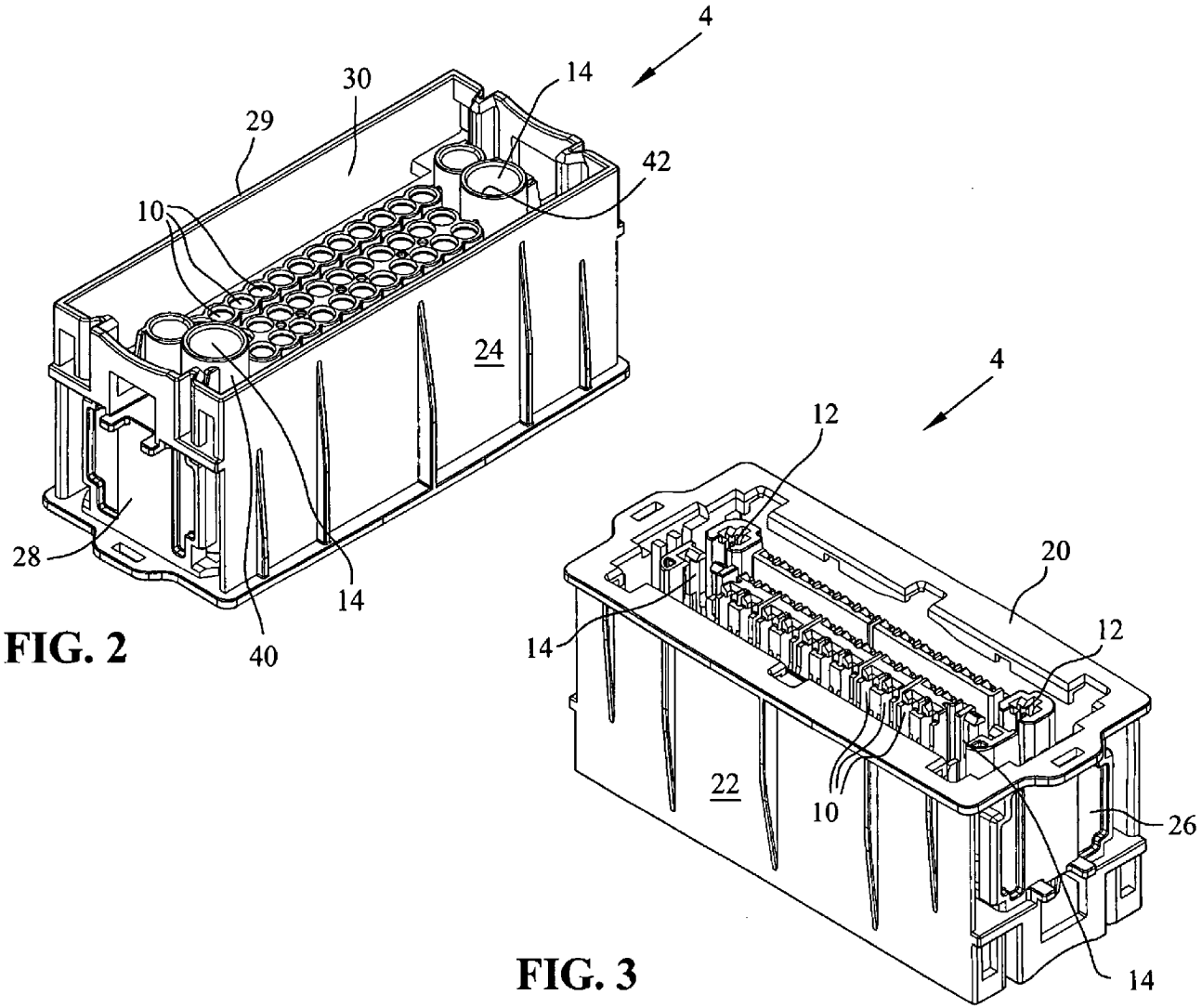
FIG. 2 is a rear perspective view of the insulative housing shown in FIG. 1.
FIG. 3 is a front perspective view of the insulative housing shown in FIG. 1.
Figure 4:
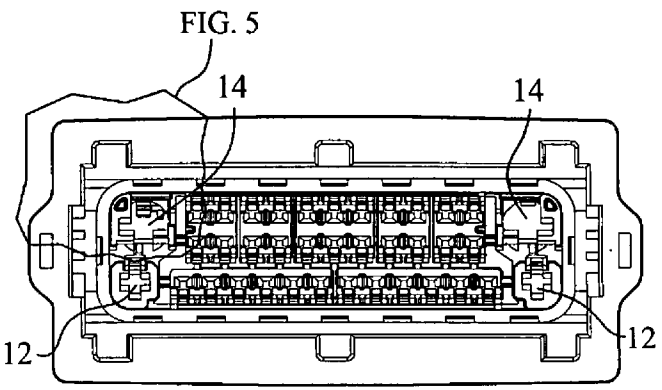
FIG. 4 is a front plan view of the insulative housing shown in FIG. 3.

With reference now to FIGS. 2 and 3, the insulative housing 4 will be described in greater detail. As shown, housing 4 is comprised of a front face 20, sidewalls 22 and 24 and end walls 26 and 28. As shown best in FIG. 2, a rear face 29 is provided with an inner cavity at 30 which could receive a planar seal for sealing the multiple cavities 10.

With respect now to FIGS. 2, 5 and 6, terminal receiving cavity 14 will be described in greater detail. As shown in FIG. 2, cavity 14 includes an insulative tube 40 which defines an inner diameter 42. Tube 40 extends inwardly to a base wall 48 (FIG. 6) having a primary latch 50 extending downwardly therefrom, where a space is defined between the base wall 48 and the primary latch 50. Primary latch defines a terminal retaining surface at 52. The terminal receiving cavity defines an opening for the terminal 130 (described herein) and an opening for a mating contact. Primary latch 50 also includes apex 56, which is the closest point of primary contact, to a centerline of the terminal receiving cavity 14.

Figure 5:
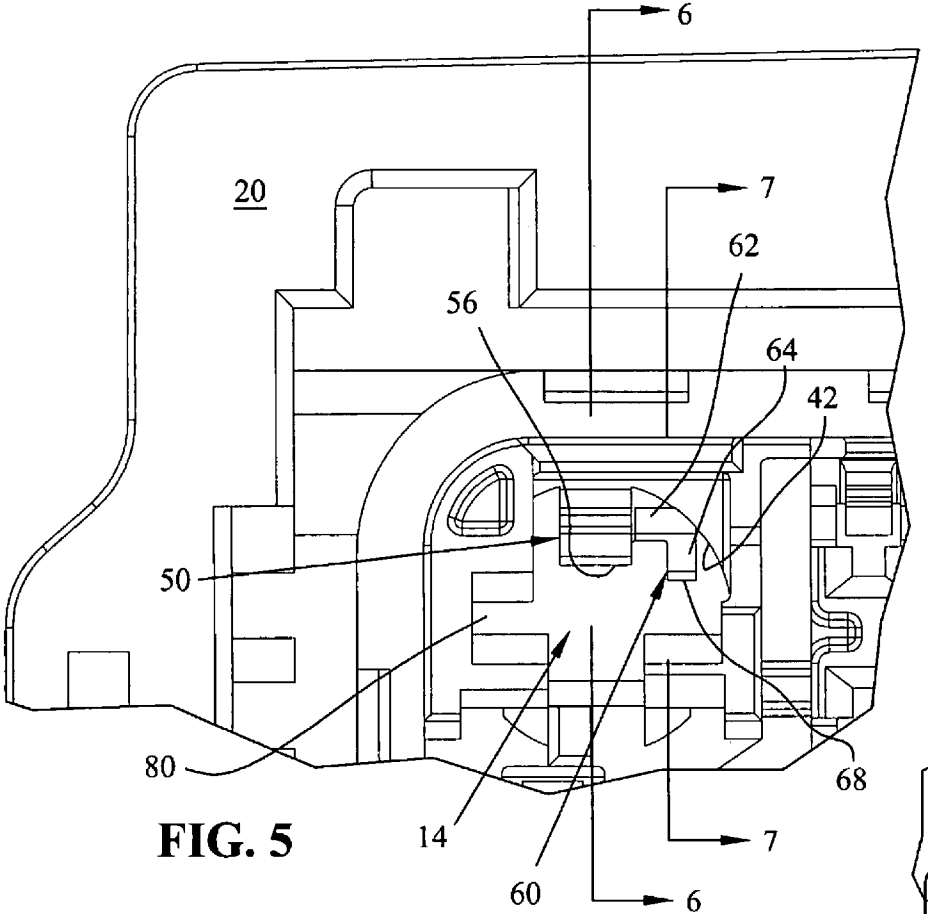
FIG. 5 is an enlarged fragmentary view of one of the terminal receiving cavities of the insulative housing as denoted in FIG. 4.
Figure 6:
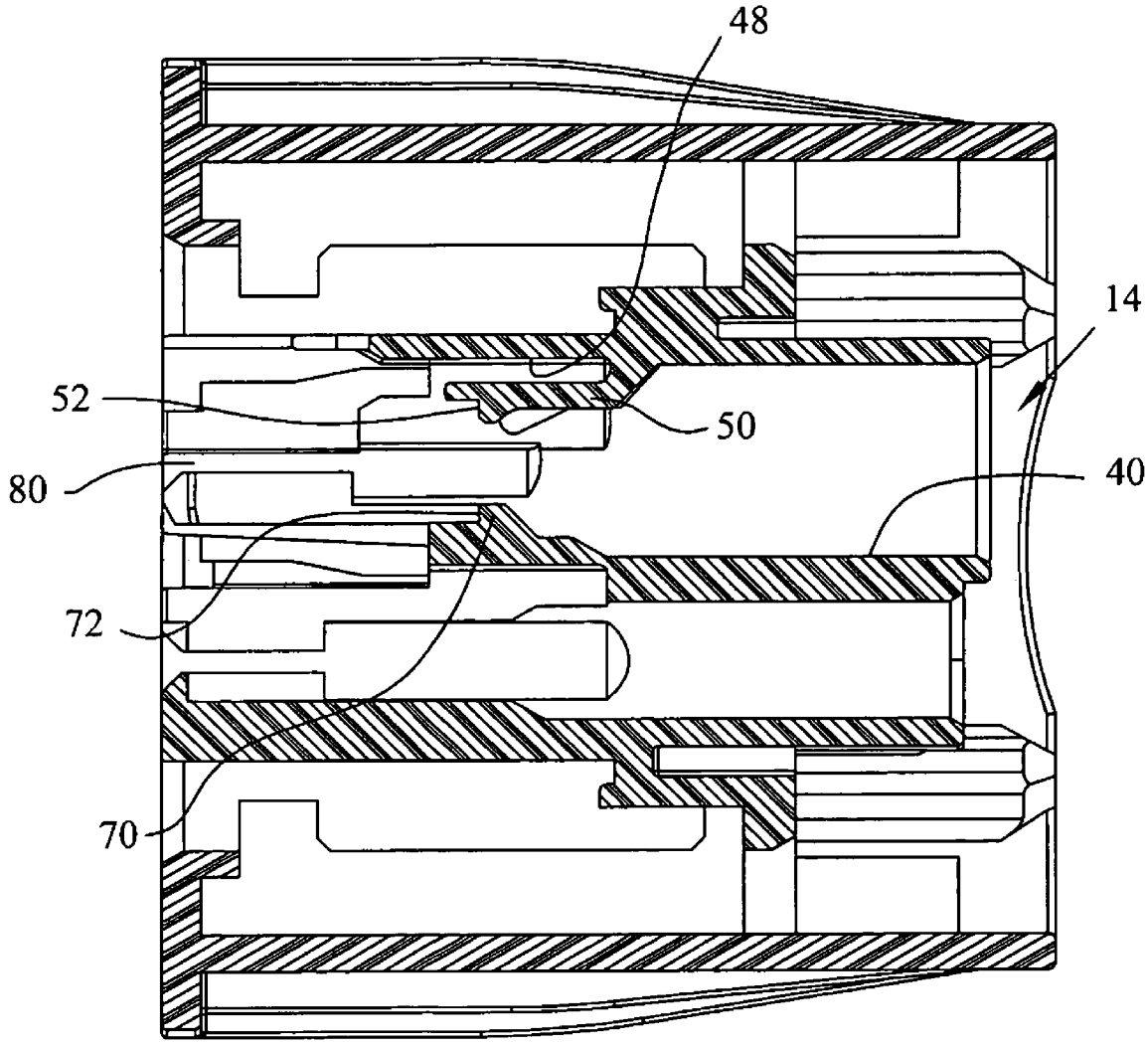
FIG. 6 is a cross-sectional view through lines 6-6 of FIG. 5.
Figure 7:
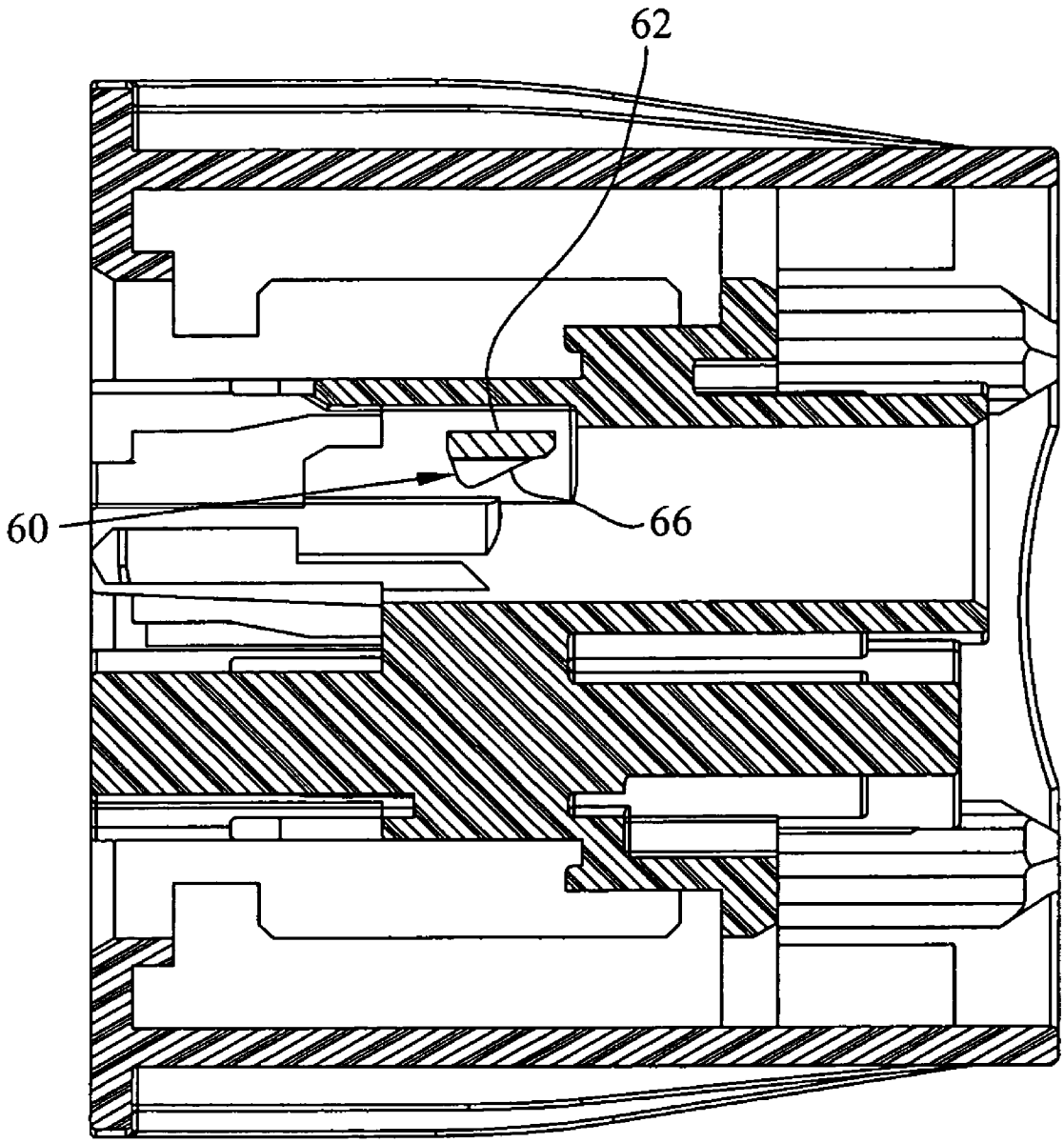
FIG. 7 is a cross-sectional view through lines 7-7 of FIG. 5.

As shown in FIG. 5, an insulative contact 60 is integrally connected to primary latch 50 by way of a laterally extending arm 62. With reference to FIGS. 5 and 7, the insulative contact 60 is comprised of a laterally extending arm 62 and a contact member 64. Contact member 64 includes a camming surface 66 as best shown in FIG. 7. As best shown in FIG. 5, contact member 64 has a contact surface 68 which is closer to the longitudinal centerline of cavity 14 then apex 56 of primary latch 50. As shown best in FIG. 6, a fixed latch 70 is shown opposed from primary latch 50 having a latching surface 72, which is longitudinally spaced along with surface 52. Finally as shown in FIGS. 5 and 6, cavity 14 defines a rectangular opening at 80, which is profiled for receipt of a blade-style mating terminal.

Figure 8:
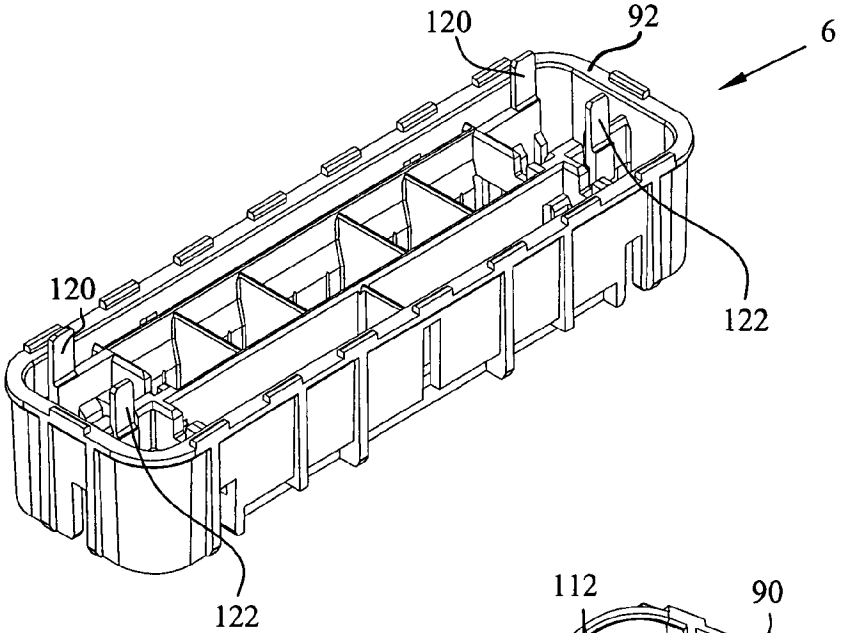
FIG. 8 is a rear perspective view of the terminal position assurance member shown in the assembly of FIG. 1.
Figure 9:
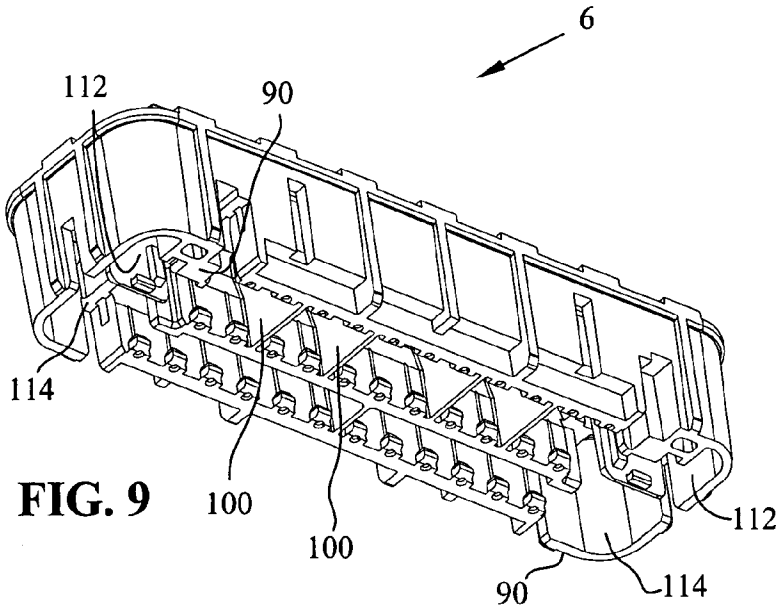
FIG. 9 is a front perspective view of the terminal position assurance member shown in FIG. 8.

With respect now to FIGS. 8 and 9, TPA 6 will be described in greater detail. TPA 6 includes a front face 90, a rear face 92 and apertures 100, 112 and 114 which help define corresponding contact receiving cavities 10, 12, and 14. As shown in FIG. 8, TPA 6 includes positioning tines 120 and 122 as more fully described herein.

Figure 10:
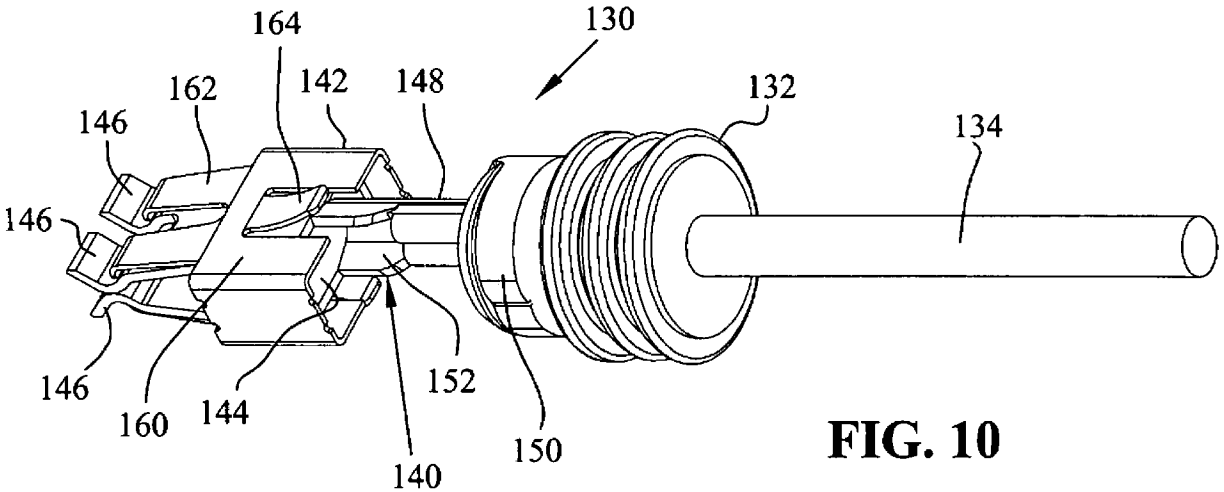
FIG. 10 shows a perspective view of an electrical terminal which may be used in association with the terminal receiving cavity shown in FIG. 5.
Figure 11:
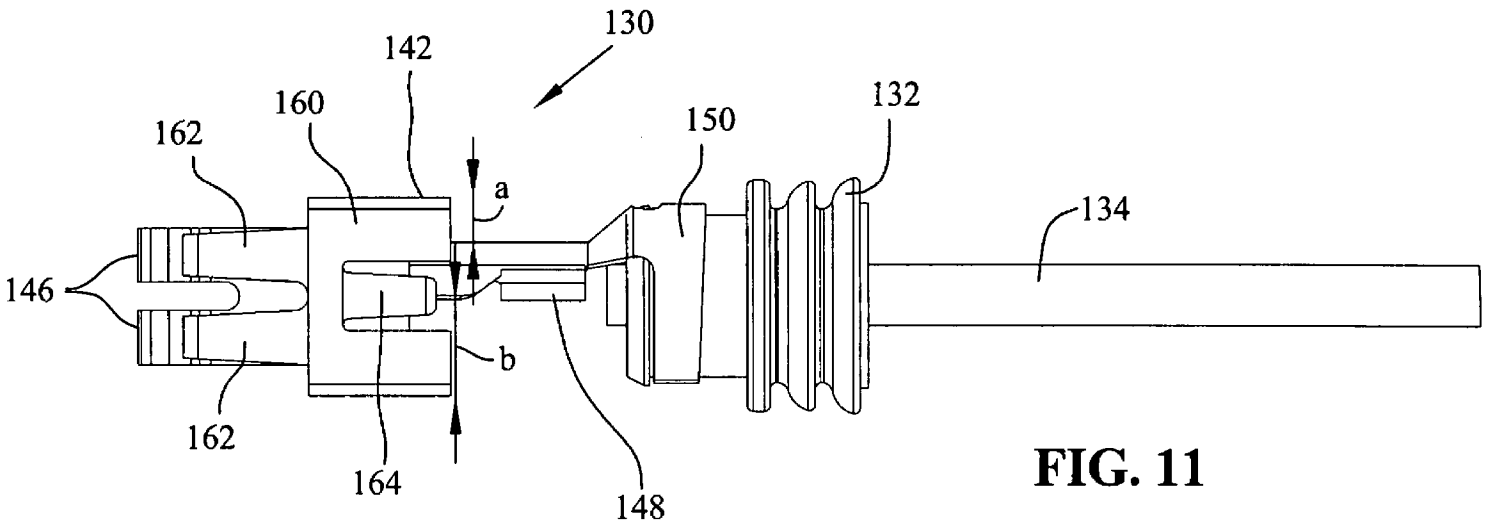
FIG. 11 is a top plan view of the electrical terminal shown in FIG. 10.

With respect now to FIGS. 10 and 11, an electrical terminal 130 is shown attached to a discreet seal 132 and terminated to an insulated conductor 134. Terminal 130 could be a receptacle-type terminal known as assignee's Standard Power Timer terminal. Terminal 130 includes an inner terminal portion 140 made of a highly conductive material and an outer backup spring 142 comprised of a spring steel. Terminal 140 includes a rectangular box-shaped portion 144 having plural cantilever contact beams 146 extending from one end thereof, and a wire crimp 148 extending from an opposite end thereof. A seal retaining ferrule 150 extends from the crimp 148 to retain seal 132 as is known in the art. Terminal 130 also includes a transition portion 152 interconnecting box-shaped portion 144 and crimp portion 148.

Backup spring 142 includes a body portion 160 which is complementary in shape to the box-shaped portion 144 and includes back-up arms 162 and a locking lance at 164. Finally and as best shown in FIG. 11, it should be noted that, the transition portion 152 and crimp 148 are somewhat offset from the longitudinal centerline of 130, that a lateral distance is available behind the backup spring 142, unencumbered by the transition portion 152 and crimp 148, namely, the distance "a" on one lateral side and a distance "b" on the opposite side thereof as more fully described herein.

Figure 12:
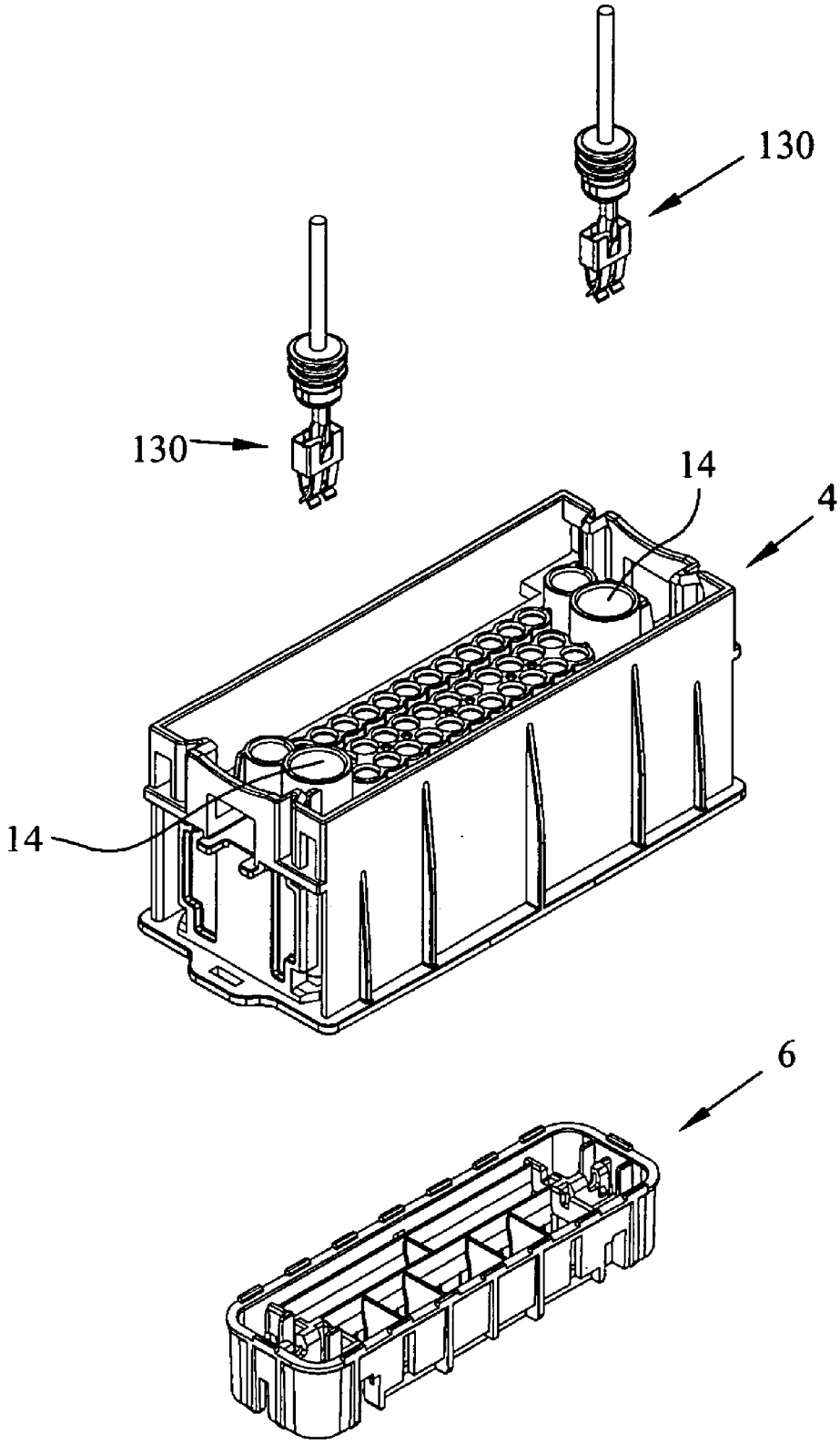
FIG. 12 shows an exploded view of the insulative housing, terminal position assurance member and terminals poised for assembly.

With reference now to FIGS. 12 through 21, the assembly and operation of the electrical connector assembly will be described in greater detail. With reference first to FIG. 12, electrical terminals 130 are shown poised for receipt in their corresponding terminal receiving cavities 14, and TPA 6 is shown poised for receipt within housing 4. It should be understood that the TPA has first and second locked positions relative to housing 4, wherein the first position, or the pre-locked position, the electrical terminals 130 may be inserted, and when the TPA 6 is moved to the second or locked position, the full insertion of all of the terminals, including electrical terminals 130 is assured.

Figure 13:
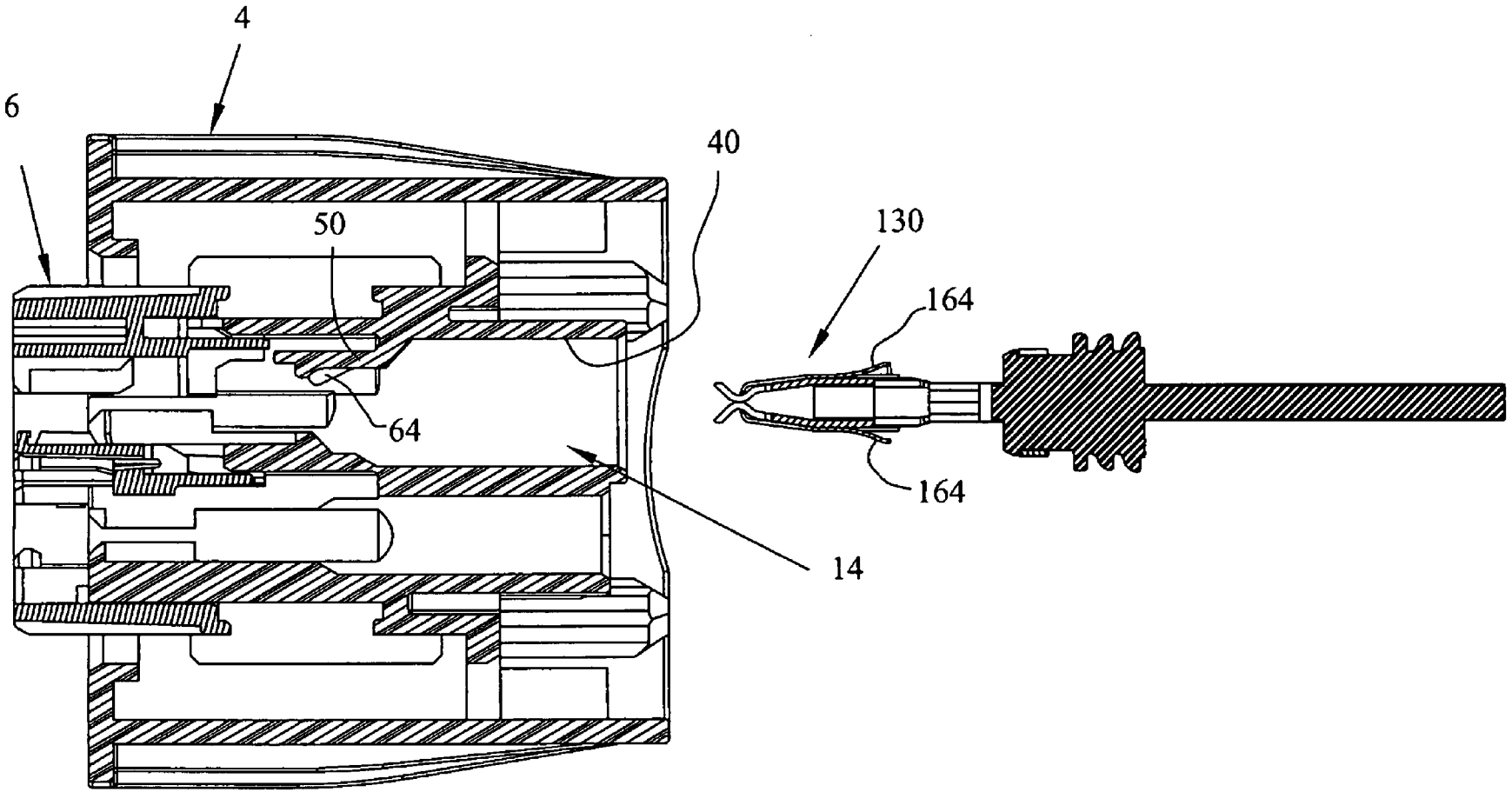
FIG. 13 shows a cross-sectional view with the insulative housing taken at a position similar to that of FIG. 6, together with the terminal position assurance member in a pre-locked position, and the electrical terminal poised for receipt into the terminal receiving cavity.
Figures 14, 15:
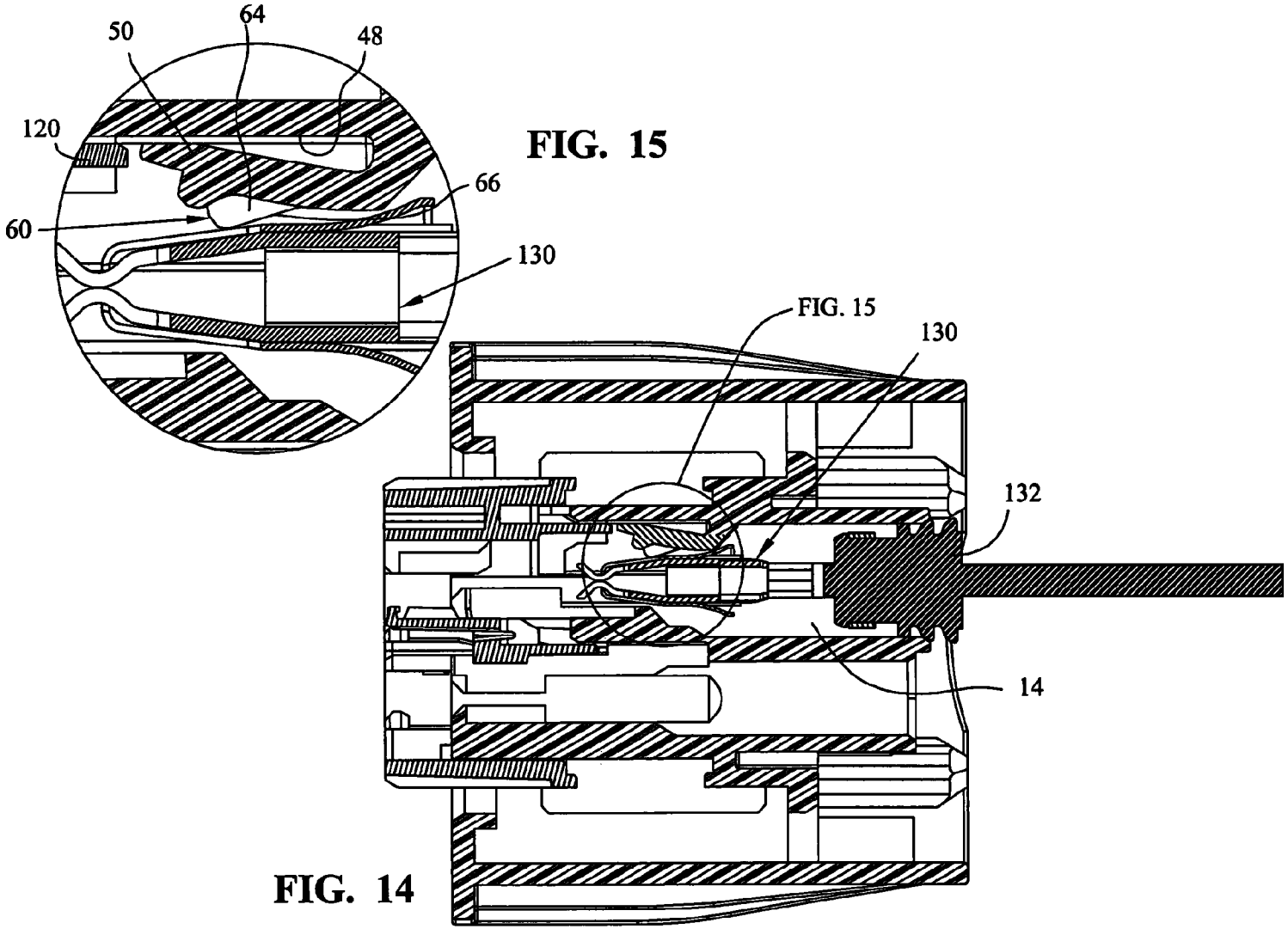
FIG. 14 shows a cross-sectional view similar to that of FIG. 13 showing the electrical terminal progressing into the contract receiving cavity and the terminal deflecting the primary latch.
FIG. 15 is an enlarged view of the portion denoted in FIG. 14.

With reference to FIG. 13, TPA 6 is shown in the pre-locked position within housing 4 and terminal 130 is shown poised for receipt in cavity 14. With reference now to FIGS. 14 and 15, terminal 130 is shown partially received in cavity 14 where primary latch 50 is deflected by way of electrical terminal 130 contacting insulative contact 60; that is, when insulative contact 60 is deflected, the deflection is transferred to primary latch 50 through laterally extending arm 62, as shown in FIG. 15.

Figures 16, 17:
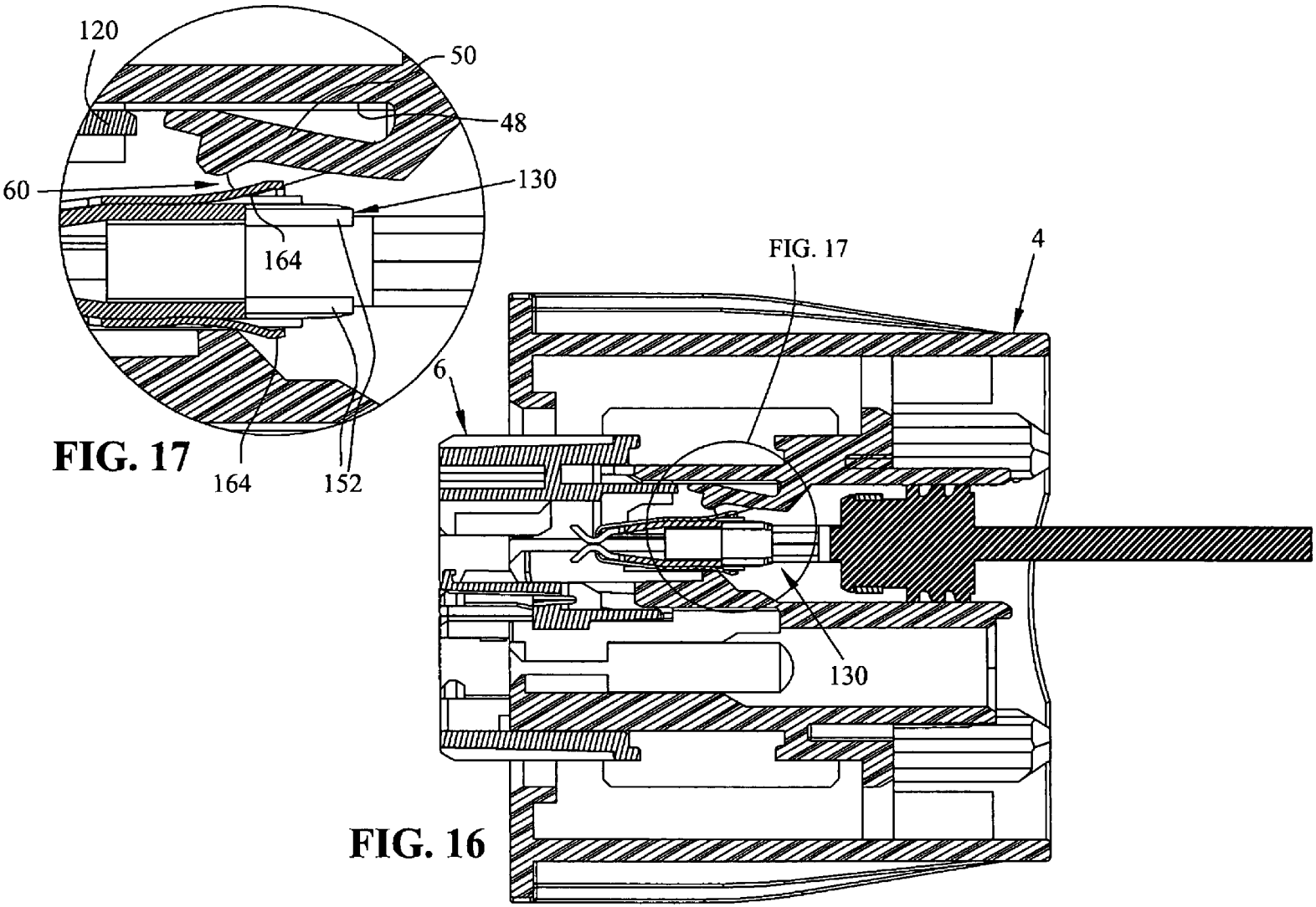
FIG. 16 shows a view similar to that of FIG. 14 showing the terminals continued progression into the terminal receiving cavity.
FIG. 17 is an enlarged view of the portion denoted in FIG. 16.
Figures 18, 19:
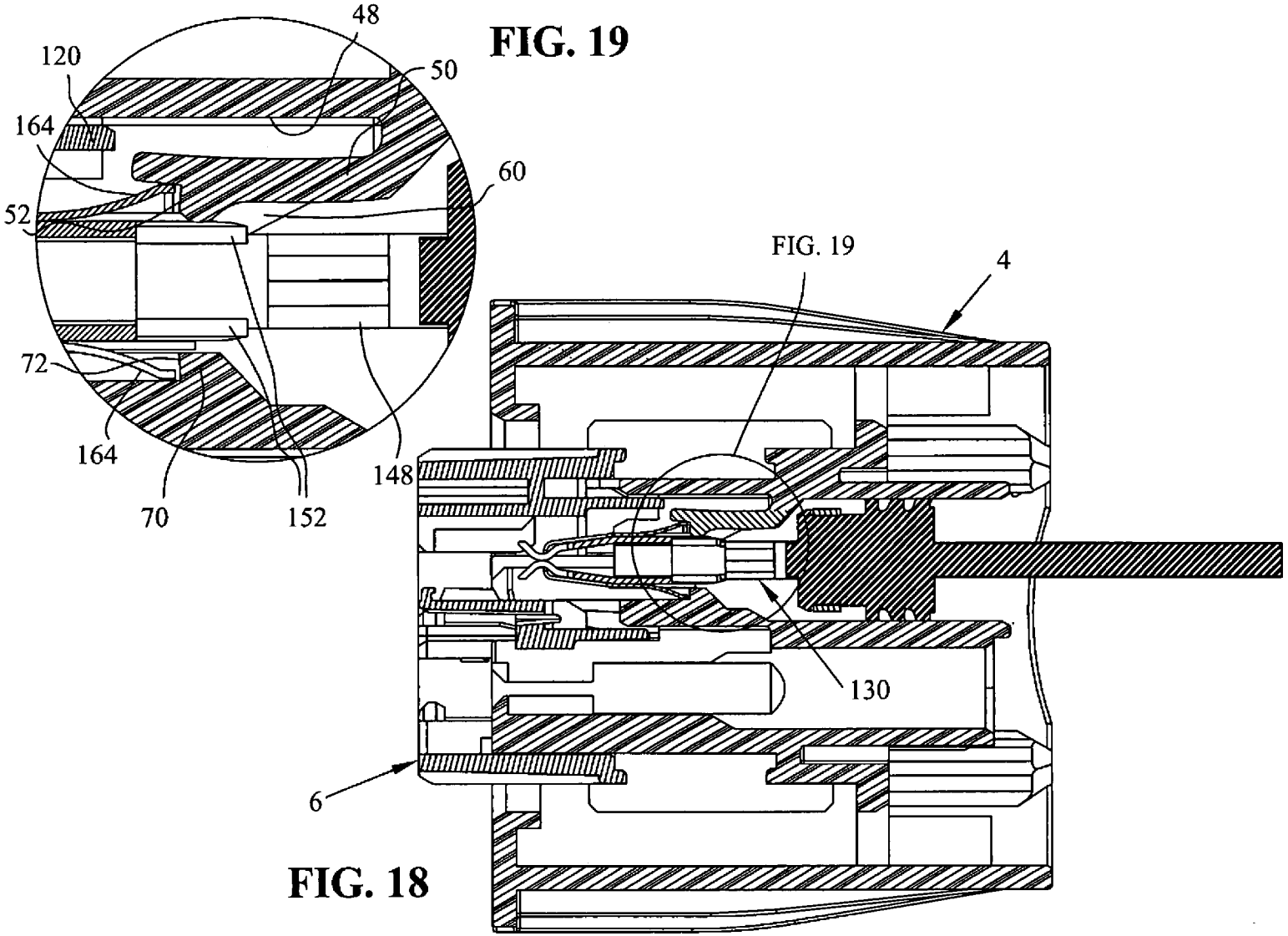
FIG. 18 is a view similar to that of FIG. 16 showing the terminal fully seated with the primary latch resilient biased into place, with the terminal position assurance member still in the pre-locked position.
FIG. 19 shows an enlarged view of the portion denoted in FIG. 18.

With respect now to FIGS. 16 and 17, terminal 130 is further inserted whereby insulative contact 60 is now positioned over the locking lance 164. With respect now to FIGS. 18 and 19, electrical terminal 130 is fully inserted whereas in FIG. 19, locking lances 164 are locked in place with their respective locking surfaces 52, 72. It should also be noted that primary latch 50 has resiled back to its original position away from base wall 48 and that insulative contact 60 has dropped down within the space "a" (FIG. 11). It should be appreciated that the electrical terminals 130 as well as the primary latch and insulative contact 60 may be designed and/or profiled to provide the lateral arm 62 in any orientation to the position within the space "a" or "b".

Figure 20:
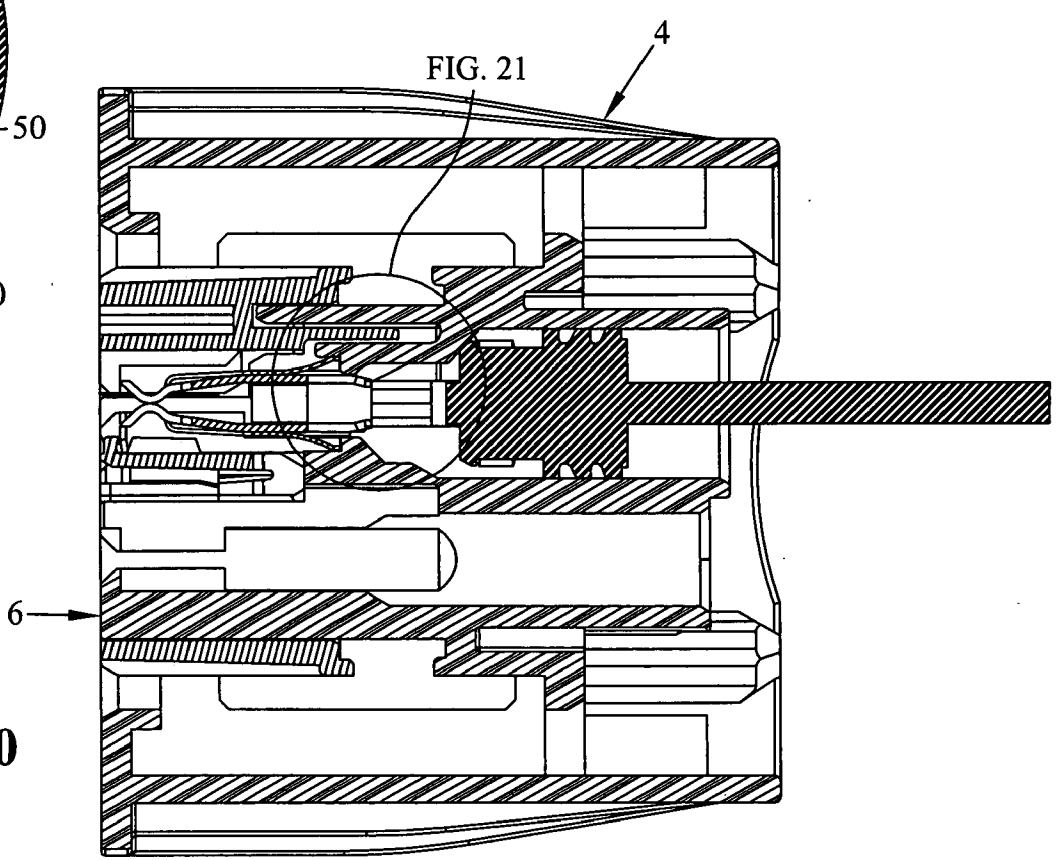
FIG. 20 shows a view similar to that of FIG. 19 with the terminal position assurance member now in the fully locked position.
Figure 21:
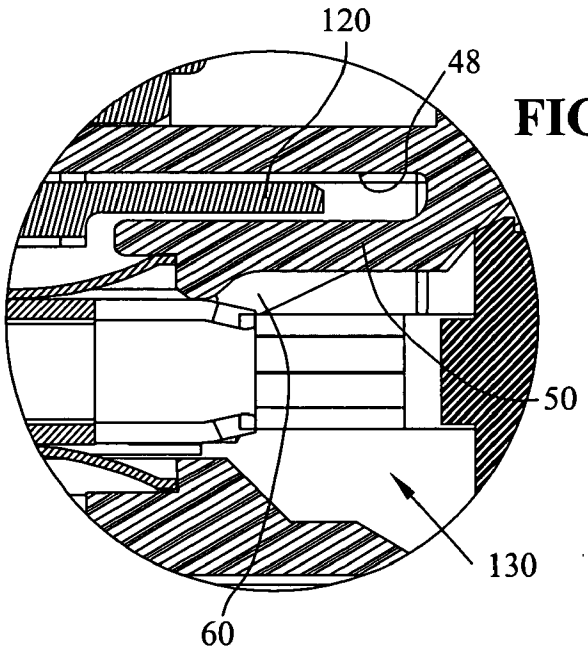
FIG. 21 shows an enlarged view of the portion denoted in FIG. 20.

With reference now to FIGS. 20 and 21, TPA 6 may now be moved from the pre-locked position to the fully-locked position shown in FIG. 20, at which time positioning tine 120 is positioned within the space between base wall 48 and primary latch 50. If the electrical terminals 130 had not been in their fully seated position, for example, if terminal had only been in the position of FIG. 15 or 17, an attempt to move TPA 6 to its fully locked position would cause an abutment between positioning tine 120 and primary latch 50. This signals to the assembler that one or more of the terminals is not fully seated.

What is claimed is:

1. An electrical connector assembly, comprising:

an insulative housing comprised of:

at least one terminal receiving cavity having a longitudinal centerline, the cavity having a terminal opening and a mating terminal opening;

a primary latch positioned in said cavity providing a space between said primary latch and a base wall;

an insulative contact extending laterally of said primary latch and profiled to deflect said primary latch towards said base wall upon deflection of said insulative contact;

a distance between said primary latch and said longitudinal centerline being greater than a distance between the insulative contact and said longitudinal centerline;

an electrical terminal positioned in said at least one cavity; and a terminal position assurance member insertable below said primary latch and within said space;

whereby, when the electrical terminal is fully inserted, the space is sufficient to accept the terminal position assurance member, and when the terminal is not fully inserted, the insulative contact is deflected by the electrical terminal, and the space is insufficient to accept the electrical terminal.

2. The electrical connector of claim 1, wherein said insulative contact is integral with said primary latch.

3. The electrical connector of claim 1, wherein said insulative contact is comprised of a laterally extending arm, integrally connected to said primary latch, and a contact member that extends transversely of said laterally extending arm.

4. The electrical connector of claim 3, wherein said contact member has a contact surface which is closer to said longitudinal centerline of said cavity than said primary latch.

5. The electrical connector of claim 1, wherein said electrical terminal is comprised of a front box-shaped portion and a rearwardly extending crimp section.

6. The electrical connector of claim 5, wherein said electrical terminal further comprises a locking lance, where said primary latch latches to the locking lance when the electrical terminal is fully inserted.

7. An electrical connector assembly, comprising an insulative housing comprised of at least one terminal receiving cavity, having a terminal opening and a mating terminal opening; a primary latch positioned in said cavity providing a space between said primary latch and a base wall; an insulative contact positioned within said cavity and comprised of a laterally extending arm, integrally connected to said primary latch, and a contact member that extends transversely of said laterally extending arm; an electrical terminal positioned in said at least one cavity; and a terminal position assurance member insertable below said primary latch and within said space; said insulative contact profiled to deflect upon insertion of said electrical terminal and transfer the deflection to the primary latch, whereby, when the electrical terminal is fully positioned the space is sufficient to accept the terminal position assurance member, and when the electrical terminal is not fully inserted, the insulative contact is deflected by the electrical terminal, and the space is insufficient to accept the electrical terminal.

8. The electrical connector of claim 7, wherein said insulative contact is integral with said primary latch.

9. The electrical connector of claim 7, wherein said contact member has a contact surface which is closer to said longitudinal centerline of said cavity than said primary latch.

10. The electrical connector of claim 7, wherein said electrical terminal is comprised of a front box-shaped portion with a rearwardly extending crimp section.

11. The electrical connector of claim 10, wherein said electrical terminal further comprises a locking lance, where said primary latch latches to the locking lance when the electrical terminal is fully inserted.

12. An electrical connector assembly, comprising an insulative housing comprised of at least one terminal receiving cavity, having a terminal opening and a mating terminal opening; an electrical terminal positioned in said at least one cavity comprising a locking lance, said electrical terminal having a locking surface on a rear edge of said locking lance and positioned a first distance from an inside surface of said receiving cavity upon full insertion of said terminal; a primary latch positioned in said cavity with a latching surface proximate said first distance to lock said terminal; an insulative contact positioned within said cavity, and a terminal position assurance member whereby; when the electrical terminal is fully positioned the primary latch locks the terminal in place, and when the terminal is not fully inserted, the electrical terminal engages the insulative contact, and transfer the deflection to the primary latch.

13. The electrical terminal according to claim 12, wherein when the electrical terminal is fully inserted, the terminal position assurance member may be received in a space between the primary latch and a base wall of the cavity, and when the terminal is not fully inserted, the insulative contact is deflected by the electrical terminal, and the space is insufficient to accept the electrical terminal.

14. The electrical connector of claim 12, wherein said insulative contact is integral with said primary latch.

15. The electrical connector of claim 12, wherein said insulative contact is comprised of a laterally extending arm, integrally connected to said primary latch, and a contact member that extends transversely of said laterally extending arm.

16. The electrical connector of claim 12, wherein said electrical terminal has a contact surface which is closer to said longitudinal centerline of said cavity than said primary latch.

17. The electrical connector of claim 12, wherein said electrical terminal is comprised of a front box-shaped portion with a rearwardly extending crimp section.

18. An electrical connector assembly, comprising an insulative housing comprised of at least one terminal receiving cavity, having a terminal opening and a mating terminal opening; an electrical terminal positioned in said at least one cavity comprising a locking lance, said electrical terminal having a locking surface on a rear edge of said locking lance and positioned a first distance from an inside surface of said receiving cavity upon full insertion of said terminal; a primary latch positioned in said cavity with a latching surface proximate said first distance to lock said terminal; an insulative contact positioned within said cavity, said insulative contact comprising of a laterally extending arm, integrally connected to said primary latch, and a contact member that extends transversely of said laterally extending arm whereby; when the electrical terminal is fully positioned the primary latch locks the terminal in place, and when the terminal is not fully inserted, the electrical terminal engages the insulative contact, and transfer the deflection to the primary latch.

* * * * *